US005742033A

United States Patent [19]

Park

[11] Patent Number: 5,742,033

[45] Date of Patent: Apr. 21, 1998

[54] WAVE GUIDE HAVING AN IMPROVED STRUCTURE USED IN A MICROWAVE OVEN

[75] Inventor: Hyung-ki Park, Incheon, Rep. of Korea

[73] Assignee: Daewoo Electronics Co., Ltd., Seoul, Rep. of Korea

[21] Appl. No.: 746,335

[22] Filed: Nov. 8, 1996

[30] Foreign Application Priority Data

Nov. 10, 1995 [KR] Rep. of Korea ..... 95-40818

[51] Int. Cl.[6] ..... H05B 6/72

[52] U.S. Cl. ..... 219/746; 219/748; 219/695

[58] Field of Search ..... 219/748, 746, 219/747, 749, 750, 745, 751, 695, 696, 697

[56] References Cited

U.S. PATENT DOCUMENTS

| | | | |
|---|---|---|---|
| 4,430,538 | 2/1984 | Suzuki et al. | 219/749 |
| 4,733,037 | 3/1988 | Nitta et al. | 219/748 |
| 4,808,784 | 2/1989 | Ko | 219/746 |
| 4,937,418 | 6/1990 | Boulard | 219/10.55 |
| 5,468,940 | 11/1995 | Kang | 219/746 |
| 5,512,736 | 4/1996 | Kang et al. | 219/750 |

FOREIGN PATENT DOCUMENTS

| | | | |
|---|---|---|---|
| 63-279595 | 11/1988 | Japan | 219/746 |
| 3-25886 | 2/1991 | Japan | 219/746 |
| 3-25887 | 2/1991 | Japan | 219/746 |

*Primary Examiner*—Philip H. Leung

[57] ABSTRACT

Disclosed is a wave guide having an improved structure and being used in a microwave oven, by which the food contained in a heating chamber is effectively heated. The wave guide has a housing attached to a side wall of the heating chamber, and has first, second, and third guide plates which are spaced at a predetermined distance apart from each other. The first guide plate has a first wave diffusing opening, the second guide plate has two second wave diffusing openings, and the third guide plate has four third wave diffusing openings. The second wave diffusing openings are off-set from the first wave diffusing opening. The third wave diffusing openings are off-set from the second wave diffusing openings. By the wave guide, superimposed high-frequency microwaves are radiated into the heating chamber, so the heating efficiency is improved and the cooking time is shortened. The microwave oven having the wave guide can prevent a waste of electrical power. By the wave guide, it is possible to use a transformer having a relatively small electrical capacity, so the manufacturing cost of the microwave oven is reduced.

8 Claims, 3 Drawing Sheets

WAVE GUIDE HAVING AN IMPROVED STRUCTURE USED IN A MICROWAVE OVEN

BACKGROUND OF THE INVENTION

1. Field of the Invention

The present invention relates to a microwave oven, and more particularly to a wave guide having an improved structure and being used in a microwave oven, by which superimposed high-frequency microwaves can be radiated towards food to be heated, thereby effectively heating the food.

2. Prior Arts

As is well known, a microwave oven is an appliance for heating food by passing microwaves through the food. Generally, the microwave oven has a magnetron which generates microwaves as a high-voltage is applied thereto. In the microwave oven, the magnetron generates approximately 2,450 MHz microwaves. When the high-frequency microwaves are applied to the food contained in a heating chamber, particles of the food are rapidly moved so that a frictional heat is generated due to a friction between the particles. The microwave oven heats the food by using the frictional heat.

Such microwaves are generated when a high-voltage produced by primary and secondary induction coils of a transformer disposed at a bottom wall of a cabinet is supplied to the magnetron, and are radiated into a heating chamber through a wave guide.

FIG. 4 shows such a conventional microwave oven 400.

As shown in FIG. 4, conventional microwave oven 400 has a cabinet 430. Cabinet 430 includes a heating chamber 410 and a control chamber 420 which are separated with each other by a partition 415.

A wave guide 450 which guides high-frequency microwaves generated from a magnetron 440 into heating chamber 410 is attached to a predetermined position on partition 415. Magnetron 440 is coupled to a side wall of wave guide 410, an opening 452 is formed at a predetermined position on heating chamber 410. In addition, an antenna 442 for sending the high-frequency microwaves is integrally formed with magnetron 440.

A transformer 460 for generating a high-voltage is mounted on a bottom wall of control chamber 420. Transformer 460 is connected to magnetron 440 so as to apply the high-voltage to magnetron 440.

A cooking tray 480, on which food to be heated is placed, is provided in heating chamber 410. In order to uniformly heat the food, cooking tray 480 is connected to a motor 470 by a shaft 472 and is rotated while the food is being heated.

Microwave oven 400 having the above structure operates as follows.

Firstly, when a user turns on an operating switch (not shown) attached to a front portion of cabinet 430, a microcomputer (not shown) accommodated in microwave oven 400 sends an operating signal to transformer 460. As a result, transformer 460 generates the high-voltage and transfers the high-voltage to magnetron 440, so that the high-frequency microwaves are generated by magnetron 440. The high-frequency microwaves are transferred to heating chamber 410 by way of antenna 442, wave guide 450, and opening 452, so the food placed on cooking tray 480 is heated.

At the same time, the microcomputer sends an operating signal to motor 470, so that cooking tray 480 rotates while the food is being heated.

However, microwave oven 400 having the above structure has a disadvantage in that the microwaves penetrate into the food to be heated only to a limited depth. For this reason, when a large quantity of the food are placed on cooking tray 480, a portion of the food is not reached by the microwaves, so that the food is not uniformly heated.

In order to solve the above problem, another conventional microwave oven including means for stirring the substance contained in a receptacle, thereby causing all of the substance to be subjected to the microwaves in order to obtain a uniform temperature of the substance, has been proposed.

However, the above conventional microwave oven requires a sufficient stirring of the substance in order to obtain the uniform temperature of the substance. Moreover, such stirring is difficult when the substance to be heated is fragile.

On the other hand, U.S. Pat. No. 4,937,418 issued to Boulard discloses a microwave oven fitted with a wave spreader which makes it possible to make the temperature distribution inside the receptacle more uniform while minimizing the stirring to which the substance is subjected.

Boulard's microwave oven comprises a wave spreader including a wave guide. The wave guide has at least one wave-receiving openings formed at an upper portion thereof and at least one wave-diffusing openings formed at a lower portion thereof. First and second deflectors for deflecting microwaves are provided in the wave guide.

However, Boulard's wave spreader is made as a separate device and installed in a heating chamber, so the useable volume of the heating chamber is reduced.

SUMMARY OF THE INVENTION

The present invention has been made to solve the problem of the prior arts, and accordingly, it is an object of the present invention to provide a wave guide for a microwave oven by which a high-frequency microwaves are uniformly radiated into a heating chamber, thereby improving heating efficiency of food to be heated.

To accomplish the above object of the present invention, there is provided a wave guide installed in a microwave oven for guiding a high-frequency microwave into a heating chamber, the wave guide comprising:

a housing attached to a side wall of the heating chamber, the housing is provided at a side wall thereof with a magnetron for generating the high-frequency microwave; and a first means for guiding the high-frequency microwave generated from the magnetron into the heating chamber by distributing and superimposing the high-frequency microwave, the first means being installed in the housing, the first means including at least one guide plate formed with at least one wave diffusing opening.

According to preferred embodiment of the present invention, the wave guide further comprises a second means for extending the wave diffusing openings by a first predetermined length towards the heating chamber.

The first means includes first, second, and third guide plates which are spaced at a predetermined distance apart from each other. The second means includes a guider extended by a second predetermined length towards the heating chamber. The guider is integrally formed with the guide plate and the wave diffusing opening is formed through the guider.

The first guide plate is formed with a first wave diffusing opening, the second guide plate is formed with two second wave diffusing openings, and the third guide plate is formed with four third wave diffusing openings.

Each of the second wave diffusing openings is off-set from the first wave diffusing opening and each of the third wave diffusing openings is off-set from each of the second wave diffusing openings. Preferably, the guide plate is made of steel.

The microwave oven having the above structure operates as follows.

Firstly, when a user turns on an operating switch, the transformer accommodated in the microwave oven generates a high-voltage. The high-voltage is transferred to the magnetron, so that the high-frequency microwaves are generated by the magnetron. The high-frequency microwaves are transferred to the wave guide 150.

Then, the high-frequency microwaves pass through the first wave-diffusing opening formed in the first guide plate. At this time, since some of the high-frequency microwaves have been reflected by the first guide plate before they pass through the first wave-diffusing opening, the high-frequency microwaves passing through the first wave-diffusing opening are diffracted and are superimposed with each other.

Next, the high-frequency microwaves which have passed through the first wave-diffusing opening pass the second wave-diffusing openings formed in the second guide plate. At this time, since the second wave-diffusing openings are off-set from the first wave-diffusing opening, the high-frequency microwaves which pass through the second wave-diffusing openings are further diffracted and are further superimposed with each other.

Then, the high-frequency microwaves which have passed the second wave-diffusing openings pass through the third wave-diffusing openings formed in third guide plate. At this time, since the third wave-diffusing openings are off-set from the second wave-diffusing openings, the high-frequency microwaves passing through the third wave-diffusing openings are further diffracted and are further superimposed with each other.

The high-frequency microwaves which have passed through the third wave-diffusing openings radiate into the heating chamber, so the food placed on a cooking tray is heated.

While the food is being heated, the microcomputer sends an operating signal to a motor so that the cooking tray rotates and thereby, the food placed on the cooking tray is more uniformly heated.

As described above, the microwave oven having the wave guide according to the present invention radiates the superimposed high-frequency microwaves into the heating chamber, so the food contained in the heating chamber is effectively heated and thereby, the cooking time is shortened.

Further, since the superimposed high-frequency microwaves are distributed by the wave-diffusing openings while they are passing through the wave-diffusing openings, the temperature distribution inside the heating chamber is more uniform and thereby, the food contained in the heating chamber is uniformly heated.

Furthermore, the microwave oven having the wave guide according to the present invention has a high heating efficiency, so a waste of electrical power can be prevented. In addition, it is possible to use a transformer having a relatively small electrical capacity, so the manufacturing cost of the microwave oven is reduced.

BRIEF DESCRIPTION OF THE DRAWINGS

The above object and other advantages of the present invention will become more apparent by describing in detail a preferred embodiment thereof with reference to the attached drawings, in which.

DETAILED DESCRIPTION OF THE INVENTION

Hereinafter, the present invention will be described in detail with reference to the accompanying drawings.

Figure 1:
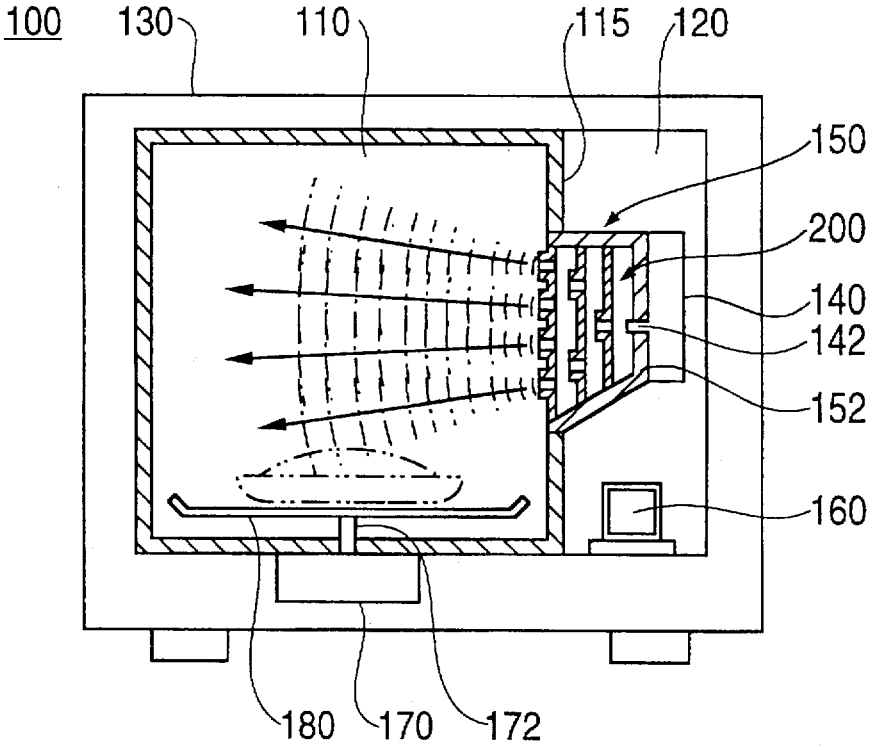
FIG. 1 is a sectional view of a microwave oven having a wave guide according to one embodiment of the present invention.

FIG. 1 shows a microwave oven 100 having a wave guide 150 according to one embodiment of the present invention.

As shown in FIG. 1, microwave oven 100 has a cabinet 130. Cabinet 130 includes a heating chamber 110 and a control chamber 120 which are separated from each other by a partition 115.

Wave guide 150, which guides the high-frequency microwaves generated from a magnetron 140 into heating chamber 110, is attached to a predetermined position on partition 115. Magnetron 140 is coupled to a side wall of wave guide 150. In addition, an antenna 142 for transmitting the high-frequency microwaves is integrally formed with magnetron 140.

A transformer 160 for generating a high-voltage is mounted on a bottom wall of control chamber 120. Transformer 160 is connected to magnetron 140 so as to apply the high-voltage to magnetron 140.

A cooking tray 180, on which food to be heated is placed, is provided in heating chamber 110. In order to uniformly heat the food, cooking tray 180 is connected to a motor 170 by a shaft 172 and is rotated while the food is being heated.

Wave guide 150 comprises a housing 152 and a wave diffusing device 200 which is installed in housing 152 in order to radiate the high-frequency microwaves generated from magnetron 140 into heating chamber 110 by superimposing and distributing the high-frequency microwaves.

Figure 2:
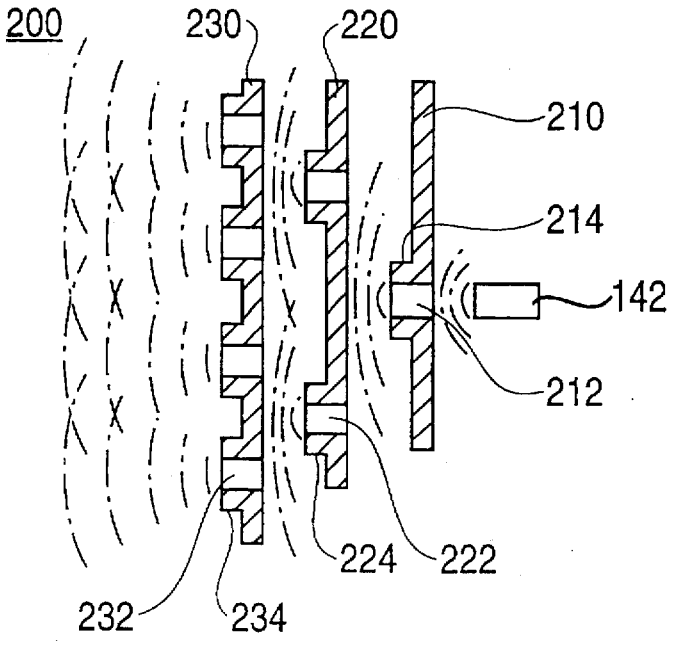
FIG. 2 is an enlarged sectional view of guide plates shown in FIG. 1.

Referring to FIG. 2, wave diffusing device 200 includes first, second, and third guide plates 210, 220, and 230 which are spaced at a predetermined distance apart from each other. First guide plate 210 is formed with a first wave-diffusing opening 212, and second guide plate 220 is formed with at least one second wave-diffusing opening 222. In addition, third guide plate 230 is formed with at least one third wave-diffusing opening 232.

According to a preferred embodiment of the present invention, two wave-diffusing openings are formed in second guide plate 220, and four wave-diffusing openings are formed in third guide plate 230.

Figure 3:
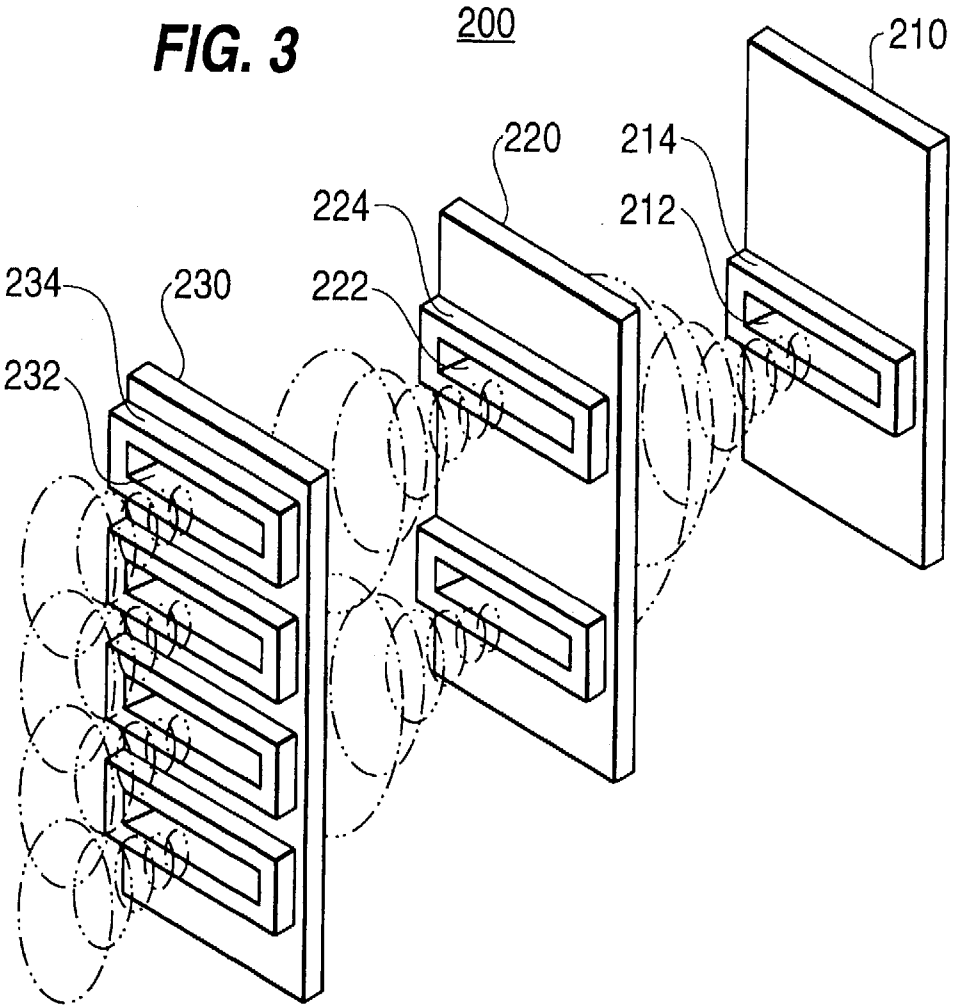
FIG. 3 is an enlarged and exploded perspective view of guide plates shown in FIG. 1.
Figure 4:
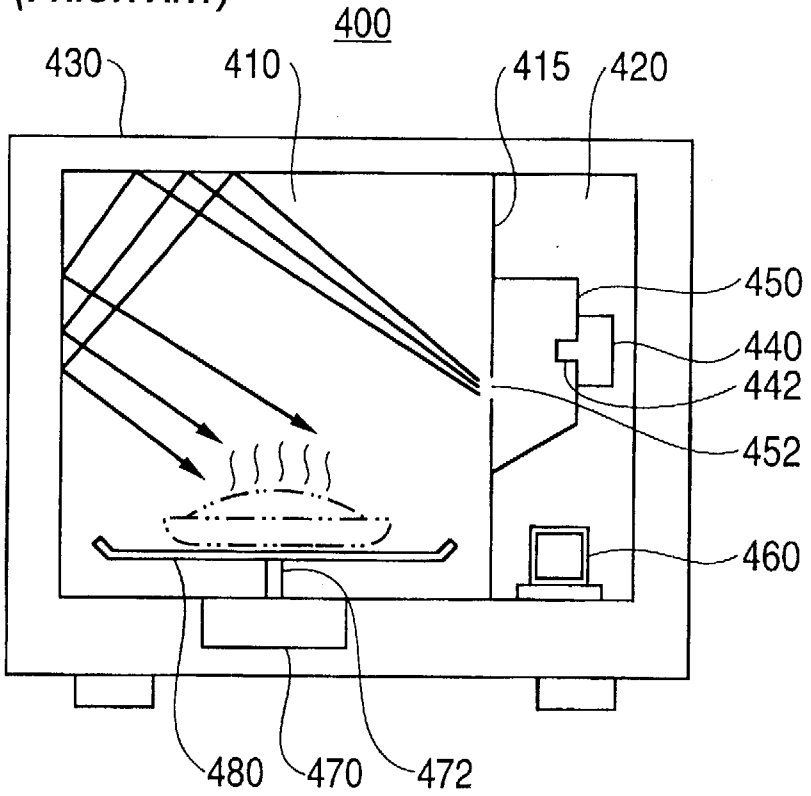
FIG. 4 (PRIOR ART)
FIG. 4 is a sectional view showing an internal structure of a conventional microwave oven.

FIG. 3 shows an exploded perspective view of wave diffusing device 200. As shown in FIG. 3, first, second, and third wave-diffusing openings 212, 222, and 232 are respectively defined by first, second, and third guiders 214, 224, 234, and are respectively extended by a predetermined length towards heating chamber 110, in such a manner that the high-frequency microwaves are effectively radiated into heating chamber 110. According to a preferred embodiment of the present invention, guiders 214, 224, and 234 are respectively integrally formed with guide plates 210, 220, and 230.

In order to superimpose the high-frequency microwaves transmitted from antenna 142, each of second wave-diffusing openings 222 is off-set from first wave-diffusing opening 212, and each of third wave diffusing openings 232 is off-set from each of second wave-diffusing openings 222. Accordingly, the high-frequency microwaves are diffracted and superimposed while they are passing through second and third wave diffusing openings 222 and 232, thereby superimposed high-frequency microwaves are radiated into heating chamber 110.

Though three guide plates are illustrated in the drawings, according to another embodiment of the present invention, two or four guide plates can be installed in wave guide 150.

In addition, the guide plates are generally made of a metal. According to a preferred embodiment of the present invention, the guide plates are made of steel.

On the other hand, a width, a length, and a thickness of the guide plate and a size of the wave-diffusing opening are selectively determined according to a size and raw material of heating chamber 110, and a size of cooking tray 180.

Microwave oven 100 having the above structure operates as follows.

Firstly, when a user turns on an operating switch (not shown) attached to a front portion of cabinet 130, a microcomputer (not shown) accommodated in microwave oven 100 sends an operating signal to transformer 160. As a result, transformer 160 generates the high-voltage and transfers the high-voltage to magnetron 140 so that the high-frequency microwaves are generated by magnetron 140. The high-frequency microwaves are transferred to wave guide 150 through antenna 142.

Then, the high-frequency microwaves pass through first wave-diffusing opening 212 formed in first guide plate 210. At this time, since some of the high-frequency microwaves have been reflected by first guide plate 210 before they pass through first wave-diffusing opening 212, the high-frequency microwaves passing through first wave-diffusing opening 212 are diffracted and are superimposed with each other.

Next, the high-frequency microwaves which have passed through first wave-diffusing opening 212 pass through second wave-diffusing openings 222 formed in second guide plate 220. At this time, since second wave-diffusing openings 222 are off-set from first wave-diffusing opening 212, most of the high-frequency microwaves which have passed through first wave-diffusing opening 212 do not directly pass through second wave-diffusing openings 222, but pass through second wave-diffusing openings 222 after they have been reflected by second guide plate 220. Accordingly, the high-frequency microwaves which pass through second wave-diffusing openings 222 are further diffracted and are further superimposed with each other.

Then, the high-frequency microwaves which have passed through second wave-diffusing openings 222 pass through third wave-diffusing openings 232 formed in third guide plate 230. At this time, since third wave-diffusing openings 232 are off-set from second wave-diffusing openings 222, most of the high-frequency microwaves which have passed through second wave-diffusing openings 222 do not directly pass through third wave-diffusing openings 232, but pass through third wave-diffusing openings 232 after they have been reflected by third guide plate 230. Accordingly, the high-frequency microwaves passing through third wave-diffusing openings 232 are further diffracted and are further superimposed with each other.

The high-frequency microwaves which have passed through third wave-diffusing openings 232 radiate into heating chamber 110, so the food placed on cooking tray 180 is heated. Since the high-frequency microwaves are superimposed and distributed by third wave-diffusing openings 232 while they are being radiated into heating chamber 110, not only is the temperature distribution inside heating chamber 110 more uniform, but also the food is more effectively heated.

While the food is being heated, the microcomputer sends an operating signal to motor 170 so that cooking tray 180 rotates and thereby, the food placed on cooking tray 180 is more uniformly heated.

In addition, since first, second, and third wave-diffusing openings 212, 222, and 232 are extended by a predetermined length towards heating chamber 110 by first, second, and third guiders 214, 224, and 234, the high-frequency microwaves transmitted from antenna 142 are easily guided into heating chamber 110.

As described above, the microwave oven having the wave guide according to the present invention radiates the superimposed high-frequency microwaves into the heating chamber, so the food contained in the heating chamber is effectively heated and thereby, the cooking time is shortened.

Further, since the superimposed high-frequency microwaves are distributed by the wave-diffusing openings while they are passing through the wave-diffusing openings, the temperature distribution inside the heating chamber is more uniform and thereby, the food contained in the heating chamber is uniformly heated.

Furthermore, the microwave oven having the wave guide according to the present invention has a high heating efficiency, so a waste of electrical power can be prevented. In addition, it is possible to use a transformer having a relatively small electric capacity, so the manufacturing cost of the microwave oven is reduced.

Although the preferred embodiment of the invention has been described, it will be understood by those skilled in the art that the present invention should not be limited to the described preferred embodiment, but various changes and modifications can be made within the spirit and scope of the invention as defined by the appended claims.

What is claimed is:

1. A wave guide installed in a microwave oven for guiding a high-frequency microwave into a heating chamber, the wave guide comprising:

a housing attached to a side wall of the heating chamber, the housing being provided at a side wall thereof with a magnetron for generating the high-frequency microwave; and a first means for guiding the high-frequency microwave generated from the magnetron into the heating chamber by distributing and superimposing the high-frequency microwave, the first means being installed in the housing, the first means including first, second, and third guide plates which are spaced at a predetermined distance apart from each other, the first guide plate being formed with a first wave diffusing opening, the second guide plate being formed with at least one second wave diffusing opening, each second wave diffusing opening being offset from the first wave diffusing opening, the third guide plate being formed with at least one third wave diffusing opening, each third wave diffusing opening being offset from each second wave diffusing opening.

2. A wave guide as claimed in claim 1, further comprising a second means for extending the wave diffusing openings by a first predetermined length towards the heating chamber.

3. A wave guide as claimed in claim 2, wherein the second means includes a guider extended by a second predetermined length towards the heating chamber, the guider being integrally formed with the guide plate, the wave diffusing opening being formed through the guider.

4. A wave guide as claimed in claim 1, wherein the second guide plate is formed with two wave diffusing openings.

5. A wave guide as claimed in claim 1, wherein the third guide plate is formed with four wave diffusing openings.

6. A wave guide as claimed in claim 1, wherein the guide plates being made of steel.

7. A wave guide installed in a microwave oven for guiding a high-frequency microwave into a heating chamber, the wave guide comprising:

a housing attached to a side wall of the heating chamber, the housing being provided at a side wall thereof with a magnetron for generating the high-frequency microwave; and a wave diffusing means including first, second, and third guide plates which are spaced at a predetermined distance apart from each other, the wave diffusing means being installed in the housing, the first guide plate being formed with a first wave diffusing opening, the second guide plate being formed with two second wave diffusing openings, the third guide plate being formed with four third wave diffusing openings, the first guide plate being formed integrally with a first guider, the second guide plate being integrally formed with two second guider, the third guide plate being integrally formed with four third guider, the first, second, and third guiders being extended by a predetermined length towards the heating chamber, the first, second, and third wave diffusing openings being formed through the first, second, and third guiders respectively, each of the second wave diffusing openings being off-set from the first wave diffusing opening, each of the third wave diffusing openings being off-set from each of the second wave diffusing openings, the guide plates being made of steel.

8. A wave guide installed in a microwave oven for guiding a high-frequency microwave into a heating chamber, the wave guide comprising:

a housing attached to a side wall of the heating chamber, the housing being provided at a side wall thereof with a magnetron for generating the high-frequency microwave; and a wave diffusing device for guiding the high-frequency microwave generated from the magnetron into the heating chamber by distributing and superimposing the high-frequency microwave, the wave diffusing device being installed in the housing, the wave diffusing device including first, second, and third guide plates which are spaced at a predetermined distance apart from each other, the first guide plate being formed with a first wave diffusing opening, the second guide plate being formed with at least one second wave diffusing opening, each second wave diffusing opening being offset from the first wave diffusing opening, the third guide plate being formed with at least one third wave diffusing opening, each third wave diffusing opening being offset from each second wave diffusing opening.

* * * * *